US008447204B2

(12) United States Patent
Qiao et al.

(10) Patent No.: US 8,447,204 B2
(45) Date of Patent: May 21, 2013

(54) SIMULATED PAPER TEXTURE USING CLEAR TONER ON UNIFORM SUBSTRATE

(75) Inventors: Mu Qiao, Castro Valley, CA (US); Marc Rene, Rochester, NY (US); William A. Fuss, Rochester, NY (US); Shen-ge Wang, Fairport, NY (US); Paul Conlon, South Bristol, NY (US)

(73) Assignee: Xerox Corporation, Norwalk, CT (US)

( * ) Notice: Subject to any disclaimer, the term of this patent is extended or adjusted under 35 U.S.C. 154(b) by 280 days.

(21) Appl. No.: 12/913,226

(22) Filed: Oct. 27, 2010

(65) Prior Publication Data

US 2012/0107007 A1 May 3, 2012

(51) Int. Cl.
*G03G 15/00* (2006.01)
*G03G 15/20* (2006.01)

(52) U.S. Cl.
USPC ..... 399/82; 399/341

(58) Field of Classification Search
USPC ..... 399/2, 82, 129, 223, 231, 341
See application file for complete search history.

(56) References Cited

U.S. PATENT DOCUMENTS

| | | | | |
|---|---|---|---|---|
| 5,189,521 | A * | 2/1993 | Ohtsubo et al. | 399/82 X |
| 7,212,772 | B2 * | 5/2007 | Kasiske et | 399/341 X |
| 7,295,341 | B2 | 11/2007 | Nagarajan et al. | |
| 7,301,675 | B2 | 11/2007 | Wang et al. | |
| 7,616,917 | B2 * | 11/2009 | Suchy et al. | 399/223 |
| 7,783,243 | B2 * | 8/2010 | Cahill et al. | 399/341 |
| 2009/0016757 | A1 * | 1/2009 | Priebe et al. | 399/58 |
| 2010/0104336 | A1 * | 4/2010 | Christopher et al. | 399/341 |

OTHER PUBLICATIONS

U.S. Appl. No. 12/968,843, filed Dec. 15, 2010 titled "System to Enable Development of Clear Toner Forms", by David C. Robinson et al.

* cited by examiner

*Primary Examiner* — Sandra Brase
(74) *Attorney, Agent, or Firm* — Fay Sharpe LLP

(57) ABSTRACT

A system is adapted for simulating a textured pattern on a non-textured substrate. The system includes generating at least a first textured description in a controller unit operatively associated with at least one image forming apparatus. The first textured description is combined with at least one image of an original print job to generate a first print job. The first textured description is printed on at least one face of a substrate to provide a perceived first textured substrate. The at least one image is then printed on the perceived first textured substrate.

19 Claims, 9 Drawing Sheets

SIMULATED PAPER TEXTURE USING CLEAR TONER ON UNIFORM SUBSTRATE

BACKGROUND

The present application is directed toward generating a perceived texture on a substrate surface and, more specifically, to a texture simulation technique applied to the substrate utilizing clear toner.

A textured substrate is a print media having a noticeable third dimension resulting from raised pattern portions. Textured substrate is used to provide an attractive appearance in products such as business cards, greeting cards, scrapbook pages, wallpaper, wrapping paper, and other paper and fabric-based merchandise. The techniques and materials used to produce the textured patterns may add significantly to the production costs. For example, a ruche pattern is achieved by bunching the material up in a linear pattern. In another example, a two-sided textured substrate is achieved by laminating together two cardstocks. Patterns tend to be applied to thicker substrates so that the material does not tear during the manipulation process.

In addition to higher consumer costs, a further disadvantage associated with textured substrate may be less sharp results during electronic printing. Traditional printing techniques, utilizing a press, provide clear text results on textured substrate because an inked surface of the press contacts the textured print media. However, ink or toner materials used for electronic, laser, digital, and xerographic printing techniques are lightly applied to the substrate. The toner or ink tends to not reach recessed portions of the substrate surface. The text printed on rough textured patterns can be illegible.

Consumer image forming devices situated in homes and offices generally print using electronic methods, and thus consumers are limited to purchasing non-textured stock. There is also a need to reduce costs of manufacturing textured substrates in commercial environments by expanding the characteristic types of substrates that may be utilized.

There is hence a need for a textured appearance produced on inexpensive substrates. There is also a need for a less expensive alternative to textured substrates that may be produced in a consumer environment. The present disclosure provides a method for applying a textured appearance to texture-less substrates using clear toner.

BRIEF DESCRIPTION

A first exemplary embodiment of the disclosure is directed toward a method for simulating a textured pattern on a uniform substrate. The method includes providing at least a first texture description for rendering a perceived non-uniform texture. A print instruction for the first texture description is concatenated with a print instruction for at least one image to form a first print job. The first texture description is printed on at least one surface of a substrate to provide a perceived first textured substrate. The at least one image is printed on the surface of the substrate.

A second exemplary embodiment of the disclosure is directed toward an apparatus for rendering a perceived texture on a substrate. The apparatus includes a clear toner applying component for rendering at least one variable layer of clear toner on a substrate surface. The clear toner forms a perceived texture on the substrate surface. A pigmented toner applying component is further included for rendering at least one layer of colored toner on the substrate surface. The colored toner forms an image. The apparatus further includes a textured image source for providing an original textured description. A processor processes image data of the original textured description to print data corresponding to the perceived texture.

DETAILED DESCRIPTION

Figure 1:
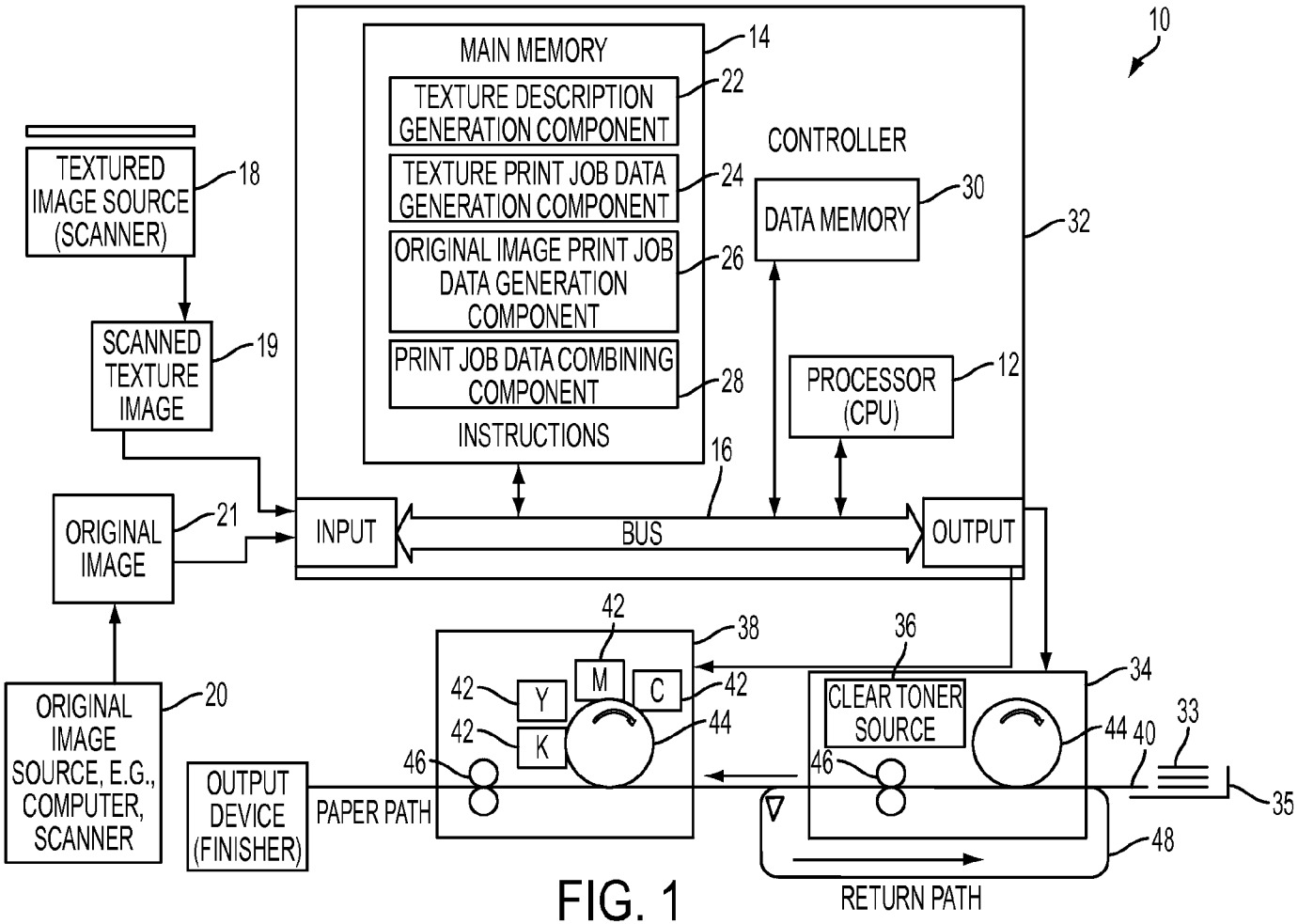
FIG. 1 illustrates a computer system for rendering a perceived textured substrate according to the disclosure.

The present disclosure is directed to a perceived textured substrate, which can be a uniform, substantially texture-less substrate having a textured appearance provided by printing. The disclosure is further directed toward a method for forming the perceived textured substrate and an apparatus adapted to produce the substrate. The substrate may be any two-dimensional material adapted to carry toner and/or liquid ink (hereinafter collectively referred to as "toner") applied using electronic, digital, xerographic, or laser printing methods. The substrate may include, for example, cardstock, papers, and fabrics.

Texture, as it is described herein, refers to a third dimension. The perceived textured substrate of the present application is substantially a two-dimensional material given a perceived third-dimensional appearance. In some embodiments, however, the material may be given an actual third dimension based on certain later discussed pile heights. More specifically, the textured substrate includes a variable (or non-uniform) surface portion. A uniform surface, as described herein, includes a generally smooth substrate surface area. A textured surface alternately includes variable heights and/or impressions formed across the surface area. Variable patterns are formed by first portions that are generally raised relative to second (recess) portions. A perceived textured substrate may include a substrate with a generally uniform surface, but having an appearance of a non-uniform surface. The perceived textured substrate may alternately include a slight non-uniform surface to the touch based on an amount of toner being applied at variable pile heights. The pile heights build raised toner portions (hereinafter referred to as "raised portions") relative to the substrate surface.

The perceived textured substrate is achieved herein by an application of clear toner on the generally uniform substrate surface. The clear toner includes non-pigmented marking particles. The clear toner is formed of the same particles used in primary and subtractive (e.g. CMY and K) toners, except that the clear toner excludes the pigmenting component. In one embodiment, the toner may have a slight cast when it is applied to the substrate. This cast may provide a visual appearance of raised portions against recesses on the substrate. The clear toner may also provide a glossy appearance.

Pigmented, colored toners are used herein to apply images to the substrate. The image generally may include information in electronic form which is to be rendered on the substrate or print media by an image forming device. The image may include text, graphics, pictures, and the like. The process for applying the image to the substrate is referred to herein as printing or marking.

As used herein, the image forming device can include any device for rendering an image on print media, such as a copier, laser printer, bookmaking machine, facsimile machine, or a multifunction machine (which includes one or more functions such as scanning, printing, archiving, emailing, and faxing). "Print media" can be a usually flimsy physical sheet of paper, plastic, or other suitable physical print media substrate for carrying images. A "print job" or "document" is referred to for one or multiple sheets copied from an original print job sheet(s) or an electronic document page image, from a particular user, or otherwise related. A (original) textured image is used herein to mean an electronic (e.g., digital) or physical (e.g., paper) recording of information. In its electronic form, the textured image may include image data in a form of text, graphics, or bitmaps.

The term "software" as used herein is intended to encompass any collection or set of instructions executable by a computer or other digital system so as to configure the computer or other digital system to perform the task that is the intent of the software. The term "software" as used herein is intended to encompass such instructions stored in storage medium such as RAM, a hard disk, optical disk, or so forth, and is also intended to encompass so-called "firmware" that is software stored on a ROM or so forth. Such software may be organized in various ways, and may include software components organized as libraries, Internet-based programs stored on a remote server or so forth, source code, interpretive code, object code, directly executable code, and so forth. It is contemplated that the software may invoke system-level code or calls to other software residing on the server or other location to perform certain functions.

The method illustrated in FIGS. 4-7 may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

With reference to FIG. 1, a functional block diagram of a computer system 10 is shown. The illustrated computer system 10 includes a processor 12, which controls the overall operation of the computer system 10 by execution of processing instructions which are stored in memory 14 connected to the processor 12. Computer system 10 also includes a network interface and a user input output interface. The I/O interface may communicate with one or more of a display, for displaying information to users, and a user input device, such as a keyboard or touch or writable screen, for inputting instructions, and/or a cursor control device, such as a mouse, trackball, or the like, for communicating user input information and command selections to the processor. The various components of the computer 10 may be all connected by a bus 16. The processor 12 executes instructions for performing the method outlined in FIGS. 4-7. The computer system 10 may be a PC, such as a desktop, a laptop, palmtop computer, portable digital assistant (PDA), server computer, cellular telephone, pager, or other computing device (e.g., multifunction printer/copier device) capable of executing instructions for performing the exemplary method.

The memory 14 may represent any type of tangible computer readable medium such as random access memory (RAM), read only memory (ROM), magnetic disk or tape, optical disk, flash memory, or holographic memory. In one embodiment, the memory 14 comprises a combination of random access memory and read only memory. In some embodiments, the processor 12 and memory 14 may be combined in a single chip. The network interface allows the computer to communicate with other devices via a computer network, such as a local area network (LAN), a wide area network (WAN), or the internet, and may comprise a modulator/demodulator (MODEM). The memory 14 stores instructions for performing the exemplary method as well as the processed data.

FIG. 1 further illustrates the computer system 10 connected to a textured image source 18 for inputting a texture description into the computer system 10. This textured image source 18 may include an image capture device 18, such as a scanner or a camera, for converting an original three-dimensional image 19 into a two-dimensional electronic format. An original image source 20 is also connected to the computer for inputting an original image 21 into electronic format. This original image source may include the same or a separate image capture device, such as a scanner, a computer, or the like.

In another embodiment, the textured and original images 19, 21 can be input from any suitable image source 18, 20 such as a workstation, a database, a memory storage device, such as a disk, or the like. Typically, each input digital image includes image data for an array of pixels forming the image. The image data may include colorant values, such as grayscale values, for each set of color separations, such as L8a8b or RGB, or be expressed in other color space in which different colors can be represented. In general, "grayscale" refers to the optical density value of any single image data channel, however expressed (e.g., L8a8b, RGB, YCbCr, etc.). The images may be photographs, video images, combined images which include photographs along with text, and/or graphics, or the like. The images may be received in JPEG, GIF, JBIG, BMP, TIFF or other common file format used for images and which may be converted to another format such as CMYK colorant values prior to processing. Input textured and original images may be stored in the data memory during processing.

The electronic textured and original image data is processed by the processor 12 according to the instructions contained in the memory 14. The memory 14 stores a texture description generation component 22, a texture instruction generation component 24, an original image instruction data generation component 26, and a print instruction combining component 28. These components 22-28 will be later described with reference to the method. The data undergoes processing according to the various components for generating a print instruction, which is stored in the data memory 30.

The textured and original image sources 18, 20 are in communication with a controller 32 containing the processor 12 and memories 14, 30. This controller 32 may be formed as part of at least one image forming apparatus for controlling an operation of at least one marking (or print) engine for forming the perceived texture on print substrates. Alternatively, the controller 32 may be contained in a separate, remote device that is connected with the image forming apparatus. The instruction data may be output from the controller 34 for further print processing at the print engines.

The image forming apparatus includes a first print engine 34. A clear toner applying component, such as cartridge 36, supplies clear toner for applying to a substrate passing through the first print engine 34. In the illustrated embodiment of FIG. 1, the substrate 33 is delivered to the first print engine from tray 35. The apparatus may further include a second print engine 36. The second print engine 38 receives the substrate from the first print engine 34 via a paper path 40. A color applying component (i.e., a source of pigmented toner), such as colorant toner cartridge 42, supplies at least one of CMY and K pigmented colorants (or other pigmented colorants) for applying colored toner to the substrate passing through the second print engine 38.

The marking engines 34, 36 include many of the hardware elements employed in the creation of desired images by electrophotographical processes. In the case of a xerographic device, the marking engine typically includes a charge retentive surface, such as a rotating photoreceptor 44 in the form of a belt or drum. The images are created on a surface of the photoreceptor 44. Disposed at various points around the circumference of the photoreceptor 44 are xerographic subsystems which include a cleaning device, a charging station to be applied (one in the case of a clear toner applying printer, four in the case of a CMYK printer), such as a charging corotron, an exposure station, which forms a latent image on the photoreceptor, a developer unit, associated with each charging station, for developing the latent image formed on the surface of the photoreceptor by applying a toner to obtain a toner image, a transferring unit, such as a transfer corotron, for transferring the toner image thus formed to the surface of a print media substrate, and a fuser 46, which fuses the image to the substrate. The fuser 46 generally applies at least one of heat and pressure to the sheet to physically attach the toner.

Figure 2:
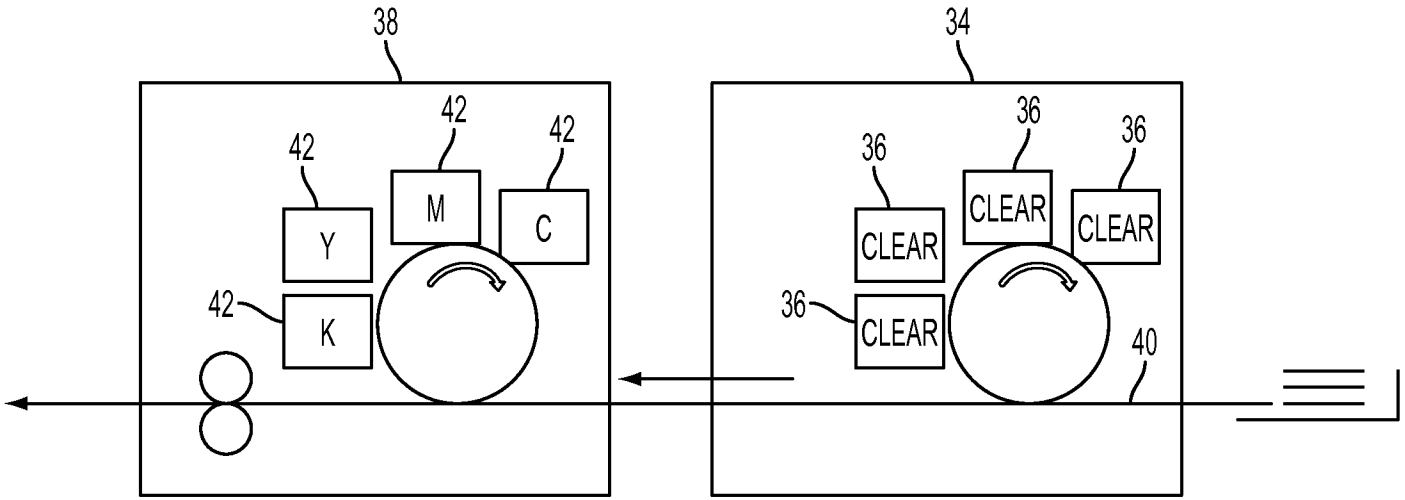
FIG. 2 illustrates a two-stage apparatus for rendering the perceived textured substrate.
Figure 3:
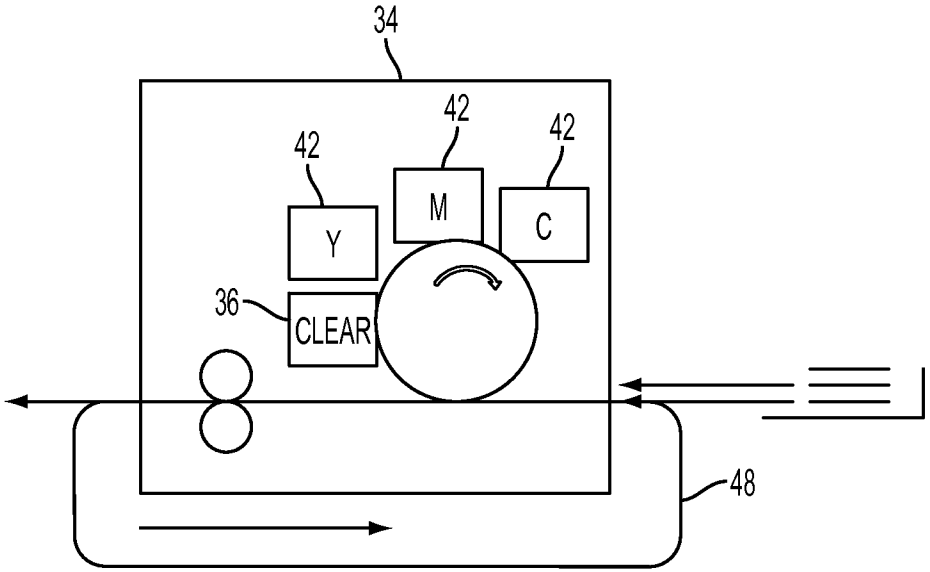
FIG. 3 illustrates a one-stage apparatus for rendering the perceived textured substrate.

The first and second print engines 34, 38 of FIG. 1 may be utilized in a two-stage process. In the two-stage process, the clear toner applying component 36 and the colored toner applying component 42 are situated in separate print engines 34, 38. In another embodiment, illustrated in FIG. 2, multiple clear toner applying components 36 may be included in a print engine. One aspect of this embodiment is that there may be fewer passes utilizing a return path 48 for building pile height. The clear toner applying component 36 may be included in the same print engine as the colored toner applying component 42, as is shown in FIG. 3, for a one-stage process.

Figure 4:
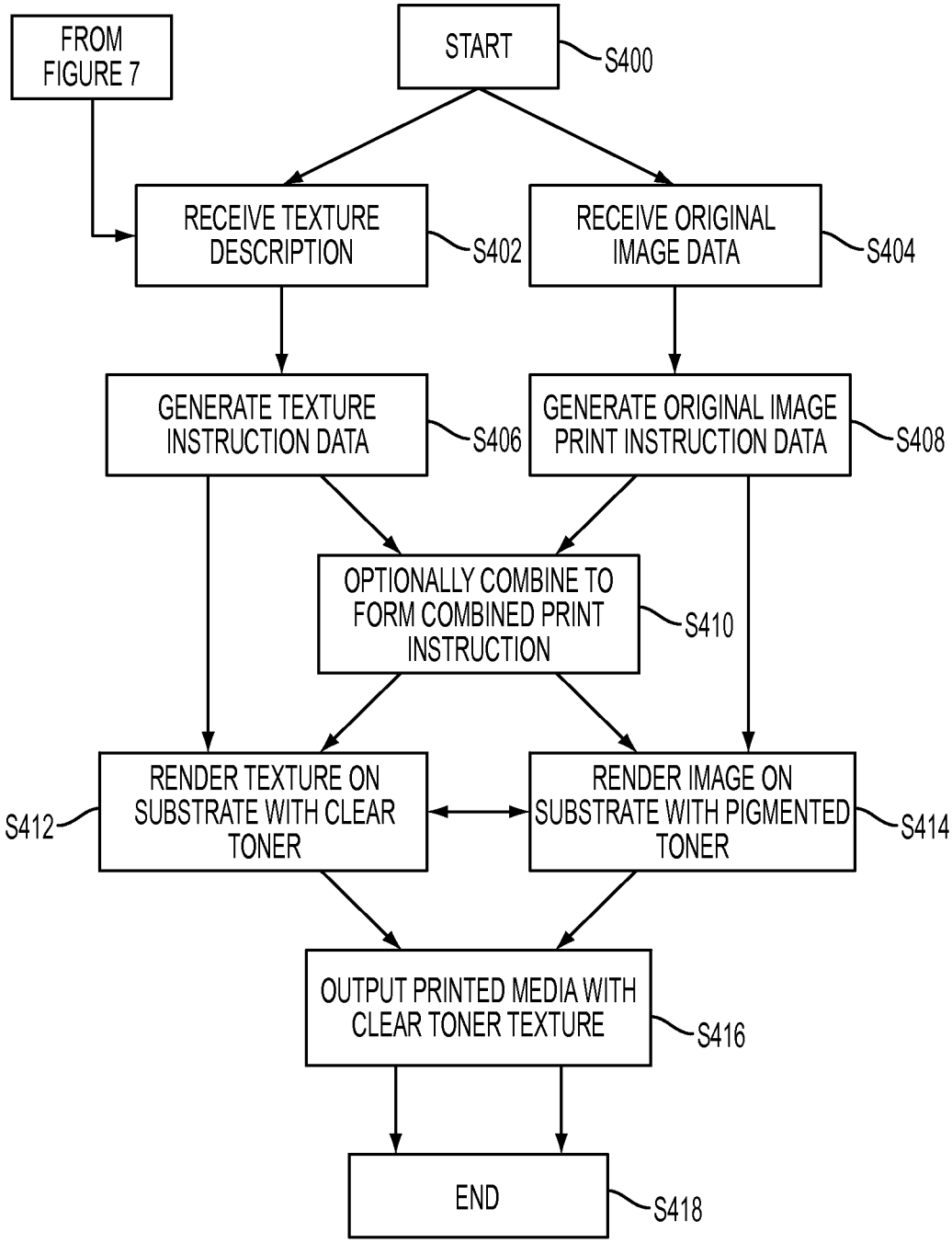
FIG. 4 is a flow chart illustrating the method embodiments according to the disclosure.

FIG. 4 illustrates an overview of the method embodiments according to the disclosure. The method starts at S400. The controller (see 32 of FIG. 1) receives a texture description at S402, which may be provided using the method described later with reference to FIG. 7. The controller further receives original image data at S404. The data corresponding to the texture description undergoes a set of instructions and/or computations to generate texture instruction data at S406. This instruction data is stored in data memory 30 of FIG. 1. The data corresponding to the original image data is also used to generate original image print instruction data at S408. This data is also stored in the data memory. The texture instruction data of S406 and the original image print instruction data of S408 may be combined at S410 to form a selected print instruction used to print a perceived textured image and a (text, pictorial, or graphical) image as a single print job. A print command sends the print job to an image forming apparatus, which sends the instructions to a marking engine. The print engine (e.g., engine 36 of FIG. 1) renders perceived texture on a substrate at S412 using a clear toner applying component. The first or a second print engine (see 42 of FIG. 1) renders the image on the substrate using a pigmented toner applying component at S414. The clear toner may be applied to the substrate before the pigmented toner in a two-stage process for the combined print instructions. Alternatively, the pigmented toner may be applied to the substrate before the clear toner in a one-stage process. Printed media is output at S416 including a layer of clear toner applied to a portion of the substrate. The method ends at S418.

Figure 5:
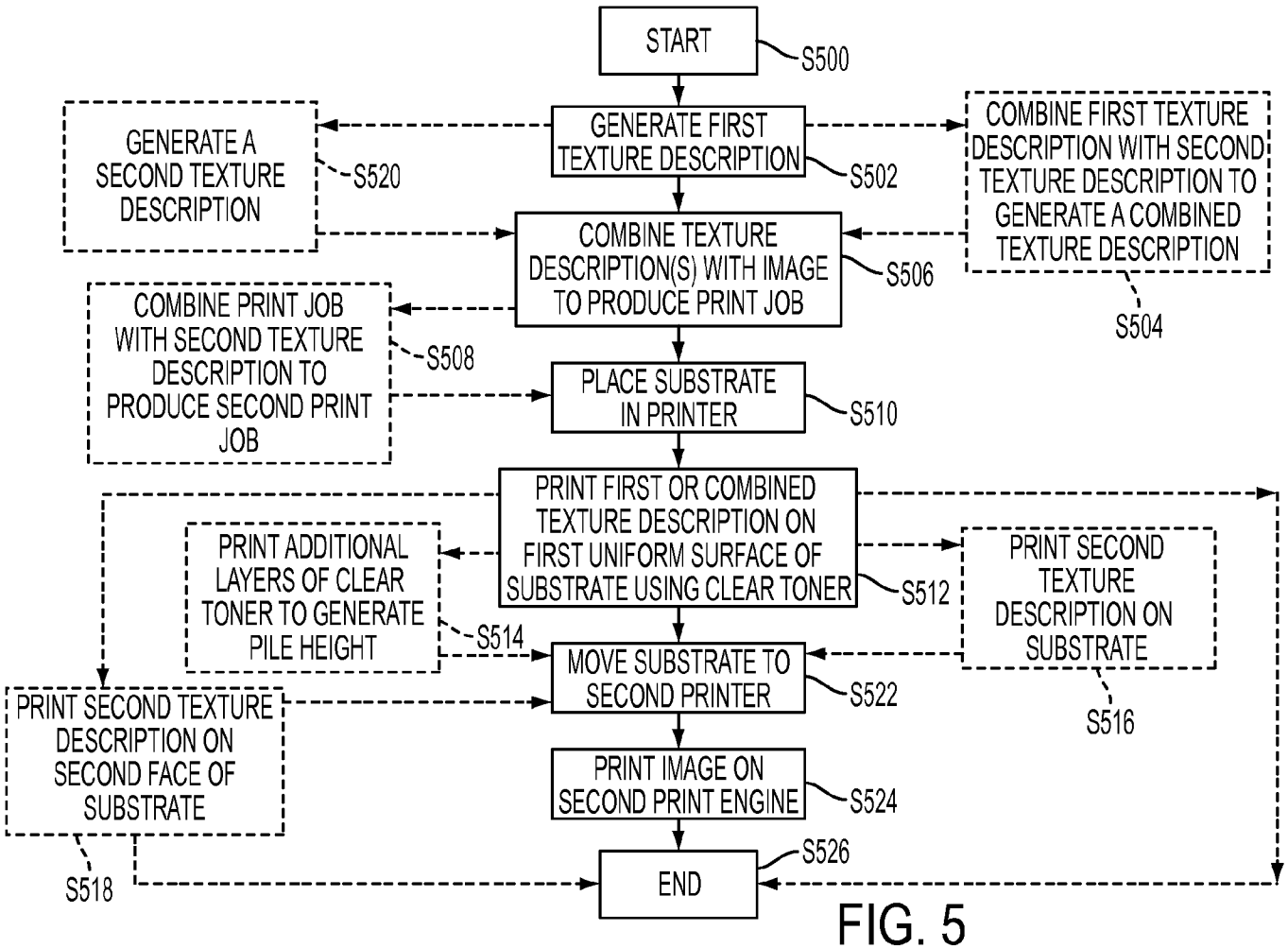
FIG. 5 is a flow chart illustrating a two-stage process of forming a printed substrate having textured appearance according to an exemplary embodiment of the disclosure.

FIG. 5 illustrates a first exemplary embodiment of the disclosure, which is the two-stage operation for producing the perceived textured substrate. This two-stage process generally includes printing the texture description on the substrate before printing the image on the substrate. The method starts at step S500. At least a first texture description is provided at S502. The method for generating a texture description is discussed later, with reference to FIG. 7. The texture description may include a selected (repeating or unitary) pattern that is programmed for application to a portion of at least one surface of a substrate. In one embodiment, an entire surface area may be covered with the pattern. In another embodiment, only selected portions may be covered. For example, the texture description may include a pattern for a border (for surrounding a later formed image), an accent, or an embossment. Furthermore, the perceived texture may be applied to only portions of the substrate that will not subsequently carry an image. There is no limitation made herein to a programmed region(s) selected for the perceived texture description.

In one embodiment, the at least first texture description may be merged with at least a second texture description at S504 to generate a combined texture description. The processor (see 12 of FIG. 1) may combine multiple texture descriptions to create a modified or a new texture description. As an example for illustrative purposes, a first texture description may be generated to provide a first repeating pattern that may cover an entire surface area of at least one surface of a substrate. A second texture pattern may be generated to provide a second embossment pattern that may cover at least one portion of the surface. The first pattern may include a subtle texture appearance, such as, for example, a hopsack pattern while the second pattern may include a bolder texture appearance, such as, for example, a floral pattern. Accordingly, the combined texture description may have an overlay appearance of a floral pattern combined with a hopsack pattern.

An instruction for the perceived texture description is combined with an instruction for a graphical or pictorial (or text) image (hereinafter collectively referred to as the "image") to generate at least a first print job S504. More specifically, the perceived texture instruction is created with the image instruction so that the set of instructions may be sent to the marking engines together as one print job. The combining action and/or merging action for concatenating the perceived texture and image instructions may be entered using a print driver. The options may be accessed, for example, via an application for print previewing, print options, or a print command. For example, the print driver may include options for concatenating the instructions. It is contemplated, however, that an image instruction may not be concatenated with the texture instruction. Rather, the perceived texture may be printed on an image forming apparatus without a simultaneous or subsequent printing of an image. In this embodiment, the image may be a blank for the action of combining a texture description with an image at S506 to produce the print job.

In an alternate embodiment, at least a generated first texture description is created with an image instruction to produce the print job at S506 before a second texture description is generated. In this embodiment, the print job may be combined with a generated second texture description to produce a modified, second print job S508. For illustration purposes, a first texture description may be formed to include a pattern for covering an entire surface area portion of the substrate. This first texture description instruction may be created with an image instruction to form the first print job. A second texture description may be combined with the print job to form a modified print job. This second image may include, for example, a border or an embossment that is arranged to surround or partially frame the image. The image is first rendered on the substrate so that there may be no overlap between the image and a frame. There is, however, no limitation made to a sequence of actions performed at the creation stage.

After the (first or modified) print job is generated, a print command may be issued. A substrate is positioned in a tray (see 35 of FIG. 1) at S510 of at least a first image forming apparatus that includes at least one clear toner applying component. The first, second, or combined texture descriptions may be printed S512 on a first surface of a substrate using a layer of clear toner. In one embodiment, however, the method may start at S512, wherein instructions are received at the marking engine from, e.g., a customer.

The clear toner imitates an appearance of texture, such as in textured substrates that are grooved or otherwise given a third-dimension. The clear toner may be applied to the substrate at different halftone values to achieve a select degree of glossiness or cast. The degree of glossiness or cast corresponds to the degree of shadow and/or shading created in three-dimensional textured substrates by raised and recessed portions. In other embodiments, the substrate may be subjected to multiple passes S514 in the image forming apparatus to achieve a select pile height. The pile height may be achieved by laying a 100% halftone value per pass. The number N of passes through the apparatus results in a 100 N % pile height. Variable pile heights may be utilized for different surface portions of the substrate so that a differential may be felt to the touch. The pile heights may be determined based on user selections made to options presented by a print driver at the creation stage S502. The pile heights may alternatively be based on programmed text patterns stored in the memory. The different amounts of toner applied to the substrate builds variable height at select regions while creating recesses at the original uniform substrate surface. Accordingly, an actual, rather than a perceived, texture may be obtained.

In one embodiment, duplex printing may be utilized to print a texture description on both sides of the substrate. The texture description may be printed on a second, opposite surface of the substrate at S516, S518 along with the first surface. In one embodiment, the same texture description may be used to print both the first and second surfaces of the substrate at S516. In another embodiment, a different texture description may be printed on the opposite surface at S518.

If different texture descriptions are printed on opposite surfaces of the substrate, a second texture description may be provided at S520. This second created texture description may be provided when the print job is created. After the duplex printing operation S518, the substrate may be automatically or manually moved to a second image forming apparatus S522. The second image forming apparatus performs a second stage in the two-stage process.

The first and second image forming apparatuses may be situated in a modular set-up contained in a shared environment. These image forming apparatuses may receive from a shared controller the print job associated with a command. Each image forming apparatus further includes components that break down its respective portion of the print job for sending it to the marking engine. After the perceived textured substrate is formed, it is moved along path 40 of FIG. 1 to the second image forming apparatus having a color applying component. In another environment, the clear applying component and the color applying component are situated in the same apparatus, and the colored image may be printed on the substrate in the same pass.

The image is printed at the second image forming apparatus at S524. If the perceived textured region covers an entire surface of the substrate, a layer of the colored toner is applied over the clear toner. Otherwise, there is no limit made to any region of the substrate of which the colored toner may be applied. When the image is formed on the substrate, the two-stage process is complete at S526.

In an alternate embodiment, the image may be formed on the substrate before the clear toner is applied on the media. In one embodiment, at least two print engines from two apparatuses may be used to respectively first print the image and then print the perceived texture. In another embodiment, one engine may form both the image and the pattern in multiple passes. FIG. 2 illustrates a second, one-stage embodiment of the disclosure. In this embodiment, one print engine applies both the colored and the clear toners on a substrate in at least one pass.

The process starts at S600. At least one image is generated S602 for producing a print job. The image may be created and issued as a print job utilizing known applications and processes. The image may be formed on the substrate at S604 in a first pass through a print engine. The image carrying material may be output from the engine as a first printout. At least a first perceived texture description may be provided at S606 for being applied to the printout. The printout may be subjected to a second pass for printing the perceived texture corresponding to the description instruction over the image and/or adjacent to the image region. In this second pass, a layer of clear colorant is applied to the image carrying substrate to form the perceived texture at S608. Alternatively, the printout may be subjected to a clear toner applying component (associated with a same or a different print engine) during the first pass immediately following a printing of the image. The substrate may be subjected to multiple passes under the clear toner for producing the select pile height S610. After the texture pattern is formed on the substrate, the process is complete S612.

The one-stage single pass process may be performed, for example, on one image forming apparatus including at least one clear toner cartridge and one colored toner cartridge. Any additional action for including a second texture description, and duplex printing, etc. may be included in the one-stage process without departing from a scope of the embodiment. Namely, the apparatus illustrated in FIG. 3 is directed toward an operation for printing an image before a texture pattern.

Figure 7:
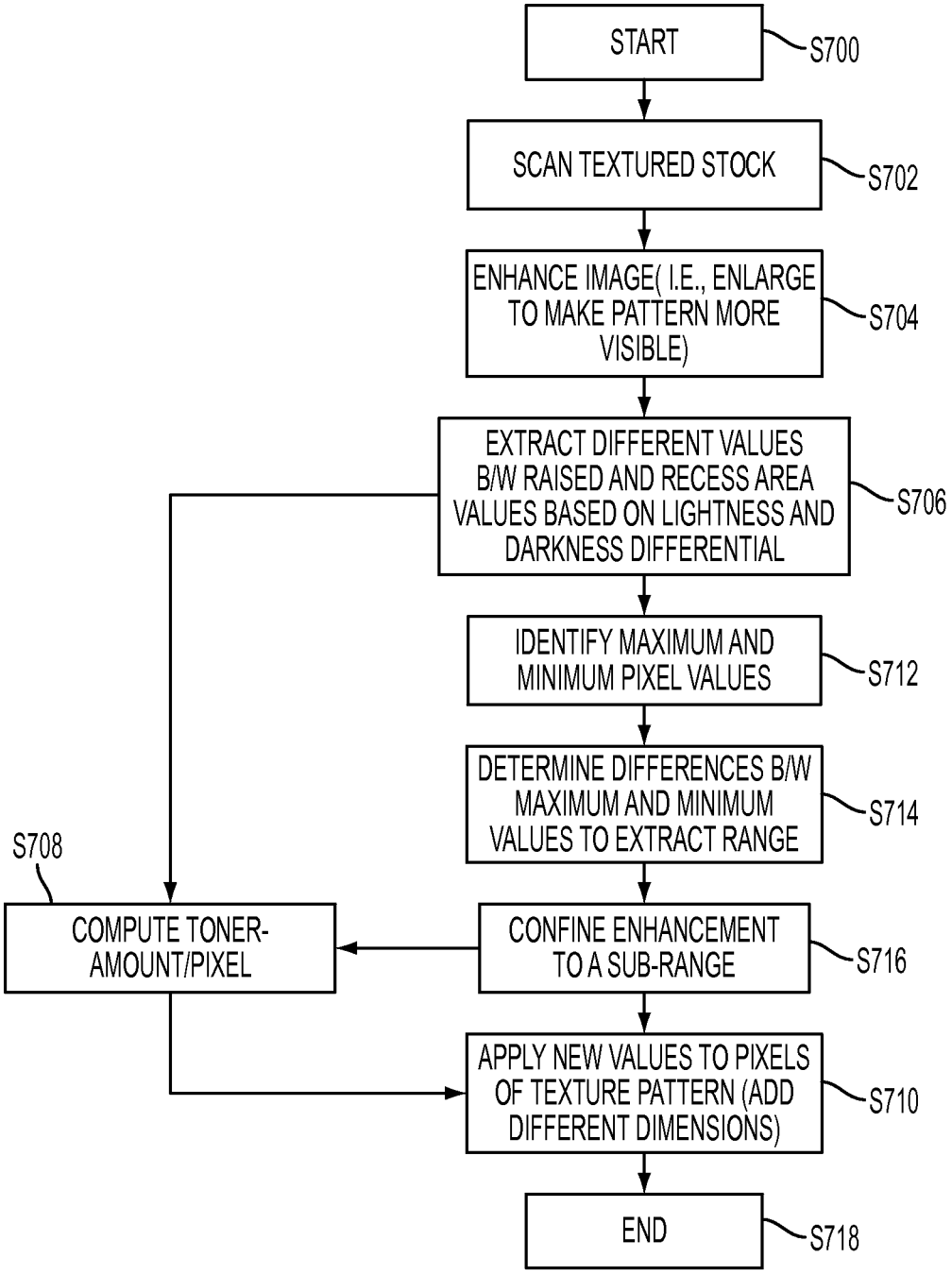
FIG. 7 is a flow chart illustrating a pre-stage process of generating a texture description.

FIG. 7 illustrates a method for generating a texture pattern according to an embodiment of the disclosure. The generation process is also referred to herein as pre-stage processing of a simulated perceived texture description. The original textured image data may be applied to the generation components 22, 24 (see FIG. 1) at the image forming apparatus or at a remote computer. This pre-stage process starts at S700. A texture description may be input into the system using the image source 18 of FIG. 1. In one embodiment, a texture data may be input into the system via an image capture device. For example, an original textured substrate may be scanned S702 to convert the three-dimensional pattern to (two-dimensional) electronic information. In one embodiment, a high resolution scanner may be used. The textured substrate is a plain (or white) substrate having no pigmented toners previously applied to it. The scanned image may be mostly white with a low dynamic range. Accordingly, an image processing algorithm may be applied to the scanned image to digitally control the amount of perceived texture subsequently printed on regular print media.

The scanned image data may be contained in the memory until selectively undergoes processing. In one embodiment, the processing of the texture description generation component and the texture print job data generation component (see 22, 24 of FIG. 1) may be instituted by means of a user selection or instruction for creating a perceived texture description. This instruction may be instituted, for example, by selection of an application for print preview or a print command option. In another embodiment, the texture generation actions may be instituted by a user selecting a "texture generation" application available with the platform used to modify the texture description in a respective program.

Figure 8:
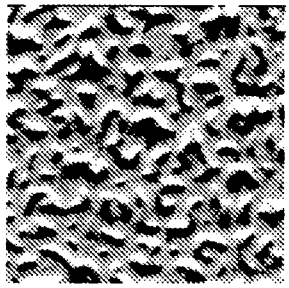
FIG. 8 illustrates an enhanced texture pattern of a three-dimensional textured substrate converted to a two-dimensional electronic format.

There are certain original textured substrates that include non-uniform regions that are microscopic, i.e., the relative raised and recess portions cannot be seen by the naked eye. To simulate their respective textures using a clear toner, these portions may be identified so that varied amounts of toners may be assigned to pixels corresponding to them. The textured description may be enlarged at S704 to make the recesses and/or raised portions viewable to the naked eye. FIG. 8 illustrates an enhanced texture of a three-dimensional textured substrate converted to electronic format.

The processor next extracts different (brightness) values S706 for distinguishing between the raised and recess regions of the original three-dimensional textured substrate. More specifically, the regions are identified by assigned image pixel values in a suitable color space (such as the L value in a Lab color space). Accordingly, each pixel of the enhanced image is described as a single number representing a brightness of the pixel between 0 and 255 on an 8-bit scale. The zero value (0) is assigned to black pixels and the value 255 is assigned to white pixels, wherein any value in between the 0 and 255 describes a different shade of gray. The shades of gray correspond to the various heights in the original textured image.

The image adaptive control parameters enable minimal user intervention. The texture description generation component (see 22 in FIG. 1) locates the intensity distribution (i.e., dynamic range) of the original textured image or scan. The dynamic range information is sent to the texture print job data generation component (see 24 in FIG. 1). The method employed may be an "S-curve" contrast enhancement algorithm that extends the dynamic range of the original texture, e.g., to the full dynamic range of 0-255.

Each one image pixel value is then included as an input variable in an algorithm. The processor (see 12 of FIG. 2) computes an amount of clear toner S708 that may be applied to the substrate for each pixel based on the value extracted in S706. The value for the clear toner amount that is output from the computation is applied to each corresponding pixel of the texture pattern S710. This value may include, for example, a halftone value. The different halftone values for the layer of clear toner add a perceived different dimension to the substrate when print output is rendered.

In an alternate embodiment, the brightness value may be applied to a Look-Up Table (LUT) such that a corresponding toner amount value is reassigned to each pixel.

In another embodiment, further actions in the process may be included to control the enhancement so that the original texture description is not over- or under-enhanced when it is converted to electronic form. The enhancement may refer to modifying a range or brightness value assigned to each pixel for controlling a degree of perceived texture applied to the substrate using the corresponding toner amount assigned to the pixel. To control the enhancement, maximum and minimum values may be identified S712 after the brightness values are extracted in S706. A difference between the maximum and minimum values may be computed at S714 to extract a range. The enhancement may then be confined to a sub-range S716 that is not as strong as the full range. In one embodiment, for example, the pixel values may be confined to a sub-range that is approximately one-half the full range. For example, the pixel values may be confined to a range of from about 63 to about 192. This function provides for additional control on how the simulated texture output will appear. More specifically, confining the pixels to a sub-range provides a perceived texture that may appear more or less similar to the actual texture.

The modified pixel values resulting from the confined enhancement S716 are applied to the algorithm (or a similar known histogram) for outputting values corresponding to a clear toner amount that may be applied to the substrate. After each one pixel is assigned a clear toner amount, the generation process is completed S718.

For generating the texture description S502, there includes alternative methods for providing a pattern description. For example, an alternate method to scanning the three-dimensional pattern to electronic form S702 may include, for example, mathematically creating a texture using existing techniques in computer graphics. The texture may be viewed on a monitor and leveraged for texting and/or shading and other visual effects on the substrate. Graphics libraries may be incorporated into and/or used by a plug-in. For example, OpenGL or DirectX built-in to a particular operating system such as Widows, Mac, or Linux may be used to access online libraries. Computer graphics algorithms may be applied to synthesized textures to provide additional realism or other visual effects. It is contemplated that textures may be procured (without cost or for a fee) from online libraries that contain a variety of hopsack, ruche, linen-embossed, hammered, burlap, floral, vector, cork, denim, and brick patterns, etc. The aforementioned list is not meant to be limiting; rather, it includes examples only.

Figure 9:
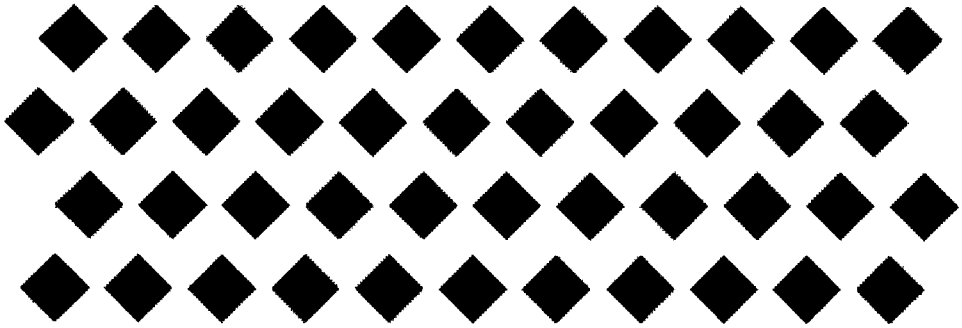
FIG. 9 illustrates a texture description formed by user design.

Another method for generating a texture description may include user-design. FIG. 9 illustrates an evenly spaced diamond pattern that may be created by a user. This spaced apart shape texture (or a similar user-created texture) may be created using known applications. The user may input different degrees of shading to describe the aimed level of dimension. The user-created texture may similarly undergo the extraction process S706, the computation process S708, or the confinement process S716 for assigning to each image pixel value a corresponding clear toner amount.

Figure 6:
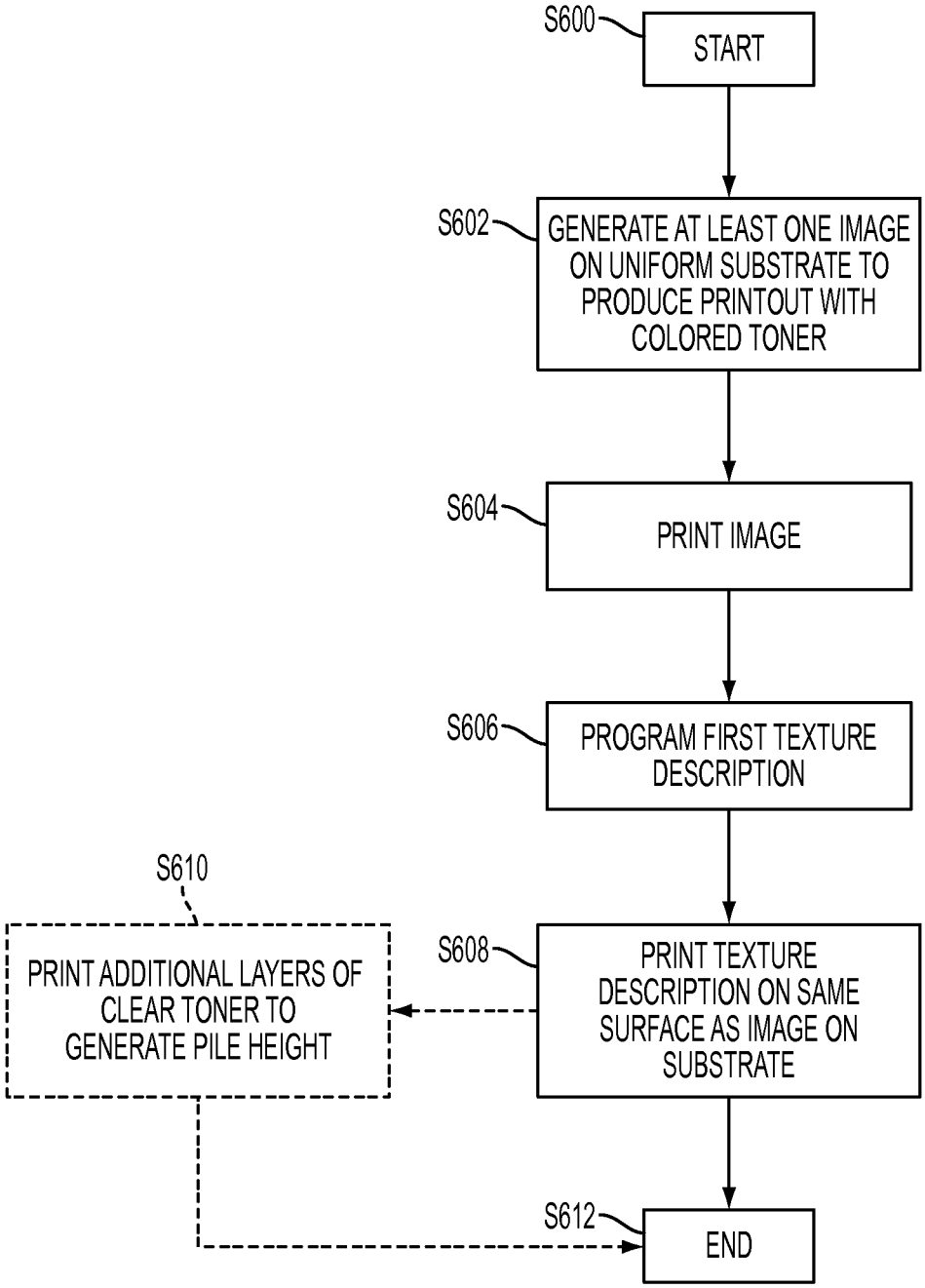
FIG. 6 is a flow chart illustrating a one-stage process of forming the printed substrate.

In yet another embodiment, the texture may be generated by utilizing edge information of an original image to be rendered on print media. FIGS. 6 and 7 show an original image used to provide an accenting texture appearance on a substrate. The original image may be generated by an image capture device, such as a scanner, a camera, or the like or it may be a graphical image. In exemplary implementation, edge information is extracted from the image to generate a binary mask edge features.

Figure 11:
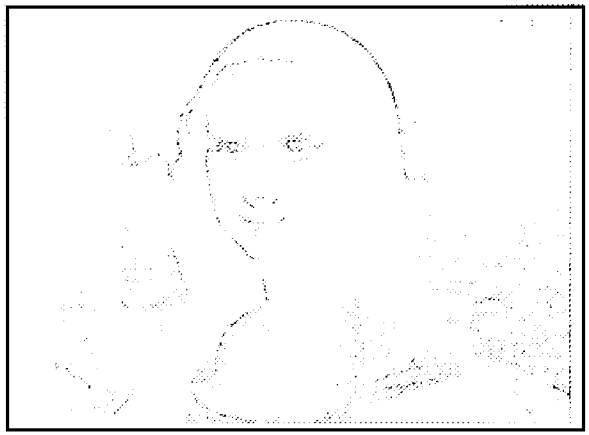
FIG. 11 illustrates an accenting effect generated by clear toner using the image of FIG. 10.
Figure 10:
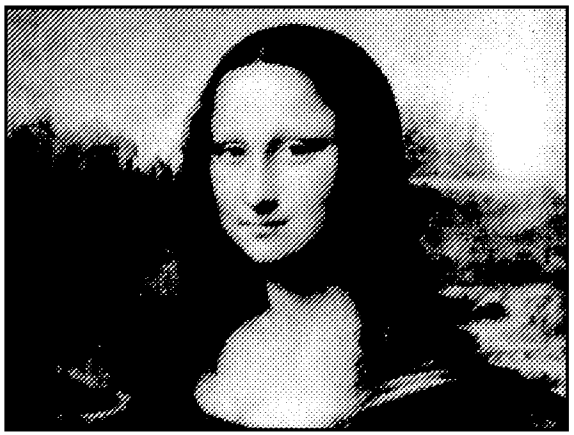
FIG. 10 illustrates an original pictorial image.

FIG. 11 illustrates an accenting effect generated by clear toner using the image of FIG. 10. The texture may be superimposed on the original image during printing stages for achieving this effect. Alternatively, the texture may be used to outline the image as an accent background for printed text.

The original image data may be sent to a print generation algorithm. Known methods may be used to identify edge pixels (only). These edge pixel values may next undergo the same extraction S706, computation S708, and confinement S712-S714 processes that were described for the scanned image pixel values of FIG. 7. Accordingly, adjustments may be made to the brightness and contrast values of edge pixels to determine the halftone amount of clear toner that may be applied to each edge pixel. The amount of toner affects the dimensional effect by creating raised and recessed portions that outline the image.

It is further contemplated in other embodiments that the system may automatically determine the texture description based on a type of substrate loaded into the apparatus.

Although the processes for generating a texture description for forming a perceived textured substrate are illustrated and described above in a form of a series of acts or events, it will be appreciated that the various methods or processes of the present disclosure are not limited by the illustrated ordering of such acts or events. In this regard, except as specifically provided herein, some acts or events may occur in different order and/or concurrently with other acts or events apart from those illustrated and described herein in accordance with the disclosure. It is further noted that not all illustrated actions may be required to implement a process or method in accordance with the present disclosure, and one or more such acts may be combined. The illustrated methods and other methods of the disclosure may be implemented in hardware, software, or combinations thereof, in order to provide the control functionality described herein, and may be employed in any system including but not limited to the above illustrated systems of FIGS. 1-3, wherein the disclosure is not limited to the specific applications and embodiments illustrated and described herein.

The enhanced texture description or any combination of the texture descriptions may be further post-processed to achieve a user specified design. For example, multiple textures may be combined in various ways for one substrate. Toner representing each one of multiple textures may be applied to the substrate based on the surface region. Each texture may alternatively be applied to the substrate based on the image content. In one embodiment, subtle highlight details may be applied using process color, black grayscale, or any combination thereof up to and including alternative toners such as pantone and light CMYK colorants. These highlight details may be applied to areas of the substrate with low CMYK toner area coverage to simulate the texture pattern.

The present disclosure may also find other applications in the print industry, such as, for example, enhancing perceived texture on textured substrates. The disclosure is not limited to the applications disclosed herein; rather, the actions may be independently used or combined to produce many perceived textures on one single substrate type, and produce perceived textures using texture descriptions without changing substrates, etc. One aspect of the disclosure is a reduction in costs of the textured substrate, which increases a profit to a print shop. Another aspect of the disclosure is a reduced inventory cost of textured substrates.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for simulating a texture on a uniform substrate, comprising:

providing a textured description for rendering a perceived non-uniform texture;

generating image data using the textured description;

concatenating a print instruction of the image data with a print instruction of at least one image to form a print job;

detecting maximum and minimum pixel values in the image data; and, applying the pixel values to an algorithm for enhancing a partial dynamic range of the textured description to a full dynamic range;

printing with a clear toner applying component the textured description on a surface of a substrate to provide a perceived textured substrate; and, printing with a pigmented toner applying component the at least one image on the surface of the substrate.

2. The method of claim 1, wherein the printing of the textured description is performed by applying varying halftone values of clear toner for each pixel of the textured description wherein the halftone value corresponds to a perceived raised or recessed portion on the surface of the substrate.

3. The method of claim 1, further including printing additional layers of the clear toner to generate a select pile height.

4. The method of claim 1, wherein the printing of the textured description is performed at a print engine and the printing of the at least one image is performed at a second print engine.

5. The method of claim 1, further including storing multiple textured descriptions in a database of the controller.

6. The method of claim 1, further including combining at least a second textured description with the original print job to generate a modified print job.

7. The method of claim 6, further including printing the second textured description on the substrate to generate a perceived multiple textured substrate.

8. The method of claim 1, wherein the printing of the textured description is rendered before the printing of the at least one image.

9. The method of claim 1, wherein the printing of the at least one image is rendered before the printing of the textured description.

10. The method of claim 1, further including:

providing a second textured description; and, printing the second textured description on an opposite surface of the substrate to provide a perceived second textured substrate surface.

11. The method of claim 1, wherein the providing of the textured description includes scanning a three-dimensional textured substrate to generate the textured image data.

12. The method of claim 1, further including confining the enhancing to a select dynamic sub-range.

13. A method of forming a perceived texture on an image-bearing substrate, comprising:

printing at least one image on a substrate to generate a printout;

providing a textured description;

extracting a brightness value for each pixel of the textured description;

enhancing a range between the values for determining an amount of clear toner to apply to each pixel for simulating a texture; and, using the determined amount, printing at least one layer of the clear toner on a surface of the substrate to provide a perceived textured substrate.

14. The method of claim 13, wherein the printing of the at least one image is performed by applying a pigmented toner to the substrate.

15. The method of claim 13, further including modifying the printout to include a color cast carried by the textured description.

16. The method of claim 13, wherein the printing of the at least one image is rendered before the printing of the layer of clear toner.

17. The method of claim 13, wherein the printing of the layer of clear toner is rendered before the printing of the at least one image.

18. An apparatus for rendering a perceived texture on a substrate, comprising:

a clear toner applying component rendering at least one variable layer of clear toner on a substrate surface, the clear toner forming a perceived texture on the substrate surface;

a pigmented toner applying component for rendering at least one layer of colored toner on the substrate surface, the color toner forming an image;

a textured image source for providing an original textured description; and, a processor for processing image data of the original textured description to print data corresponding to the perceived texture, the processor adapted to:

extract a brightness value for each pixel of the textured description;

apply the pixel value to an algorithm for enhancing a partial dynamic range of the textured description to a full dynamic range; and use the full dynamic range to assign an amount of clear toner to apply to each pixel for simulating a texture.

19. The apparatus of claim 18, further including at least one print engine for rendering the perceived texture on the substrate surface.

* * * * *